United States Patent [19]

Lightfoot

[11] 4,327,875

[45] May 4, 1982

[54] PRESSURE SENSITIVE NOTEPAPER DISPENSER

[75] Inventor: Clinton W. Lightfoot, White Bear Lake, Minn.

[73] Assignee: Minnesota Mining & Manufacturing Company, St. Paul, Minn.

[21] Appl. No.: 157,227

[22] Filed: Jun. 9, 1980

[51] Int. Cl.[3] ..... B65H 19/00

[52] U.S. Cl. ..... 242/55.53; 226/74

[58] Field of Search ..... 242/55.53, 55.3, 67.2; 225/46, 47; 226/170, 171, 74

[56] References Cited

U.S. PATENT DOCUMENTS

| | | | |
|---|---|---|---|
| 2,331,019 | 10/1943 | Flood | 242/55.53 |
| 2,961,137 | 11/1960 | Menkel | 226/53 |
| 3,014,627 | 12/1961 | Coonrod et al. | 226/74 |
| 3,101,913 | 8/1963 | Davis | 242/55.53 |
| 3,777,962 | 12/1973 | Tange et al. | 226/171 X |

*Primary Examiner*—Leonard D. Christian

*Attorney, Agent, or Firm*—Cruzan Alexander; Donald M. Sell; John C. Barnes

[57] ABSTRACT

A dispenser for notepaper having a pressure sensitive coating which dispenser has an endless belt to transport notepaper through dispenser and a guide roller to direct notepaper about one end of the belt.

4 Claims, 5 Drawing Figures

PRESSURE SENSITIVE NOTEPAPER DISPENSER

DESCRIPTION

1. Technical Field

This invention relates to a dispenser for notepaper having a pressure sensitive adhesive coated on the undersurface thereof to permit inscription on the notepaper and for a length thereof to be severed from the remainder of the roll and applied to a surface.

2. Background Art

This invention relates to a handy dispenser for a notepaper which will permit memos to be written on the notepaper and dispensed in variable length sheets, depending on the length of the note. The notepaper is a length of paper furnished in a roll which may be stored within the dispenser. The notepaper has a pressure sensitive adhesive coated on the surface opposite the writing surface to permit the notepaper to be adhered to a surface.

The dispenser has a convenient surface upon which the paper is disposed to permit the note or memo to be inscribed onto the paper. The paper may be easily advanced from the roll across the writing surface by advancing a carrier belt which extends lengthwise of the dispenser and encloses a platform such that a stretch of the belt and the platform define the writing surface such that as the length of the note increases the paper may be advanced upwardly on the writing surface.

Dispensers for notepaper furnished in rolls and free of any adhesive are known in the prior art. One such dispenser is manufactured by Mayer Manufacturing Corporation of Chicago Heights, Illinois and identified as the Mayco Rollmaster Memo and another is the Memomatic dispenser by Ketcham and McDougall, Inc. of Roseland, New Jersey, which similarly provides a dispenser for roll form notepaper. These dispensers comprise a frame having a pair of spaced parallel walls which define at one end a chamber to receive the roll of notepaper and a writing surface extending between the sidewalls and extending forwardly from the area for receiving the roll of notepaper. The notepaper is advanced around a guide member at the forward end of the frame and back across the writing surface. The paper is generally placed beneath a roller or bar extending across the writing surface and between the sidewalls of the frame which bar can serve to sever the notepaper and/or to advance the notepaper by rotation of the roller, which places the paper in contact with the undersurface of the bar.

The present invention is a dispenser particularly adapted for use with a notepaper having a pressure sensitive adhesive on the surface opposite the writing surface. The pressure sensitive adhesive renders the prior known dispensers incapable of dispensing this notepaper. The adhesive on one surface, although preferably of low tack, would interfere with the notepaper being moved over the fixed guide members as well as across the writing surface upon which the notepaper is positioned when a memo is being inscribed thereon.

DISCLOSURE OF INVENTION

The dispenser of the present invention comprises a flexible endless transport belt which serves as a backup for the notepaper and is between the notepaper and the flat support surface supporting the notepaper during writing. The dispenser has a guide roller disposed adjacent one end of the endless belt to guide the adhesive coated notepaper from one side of the endless belt around the roller and back to the opposite surface of the belt. The platform beneath the upper stretch of the endless belt supports the belt and serves as the anvil for the writing surface. The adhesive utilized on the notepaper is preferably a microstructured adhesive such as that described in U.S. Pat. No. 3,691,140.

BRIEF DESCRIPTION OF THE DRAWINGS

The present invention will be further described with reference to the accompanying drawing wherein.

BEST MODE FOR CARRYING OUT THE INVENTION

Figure 1:
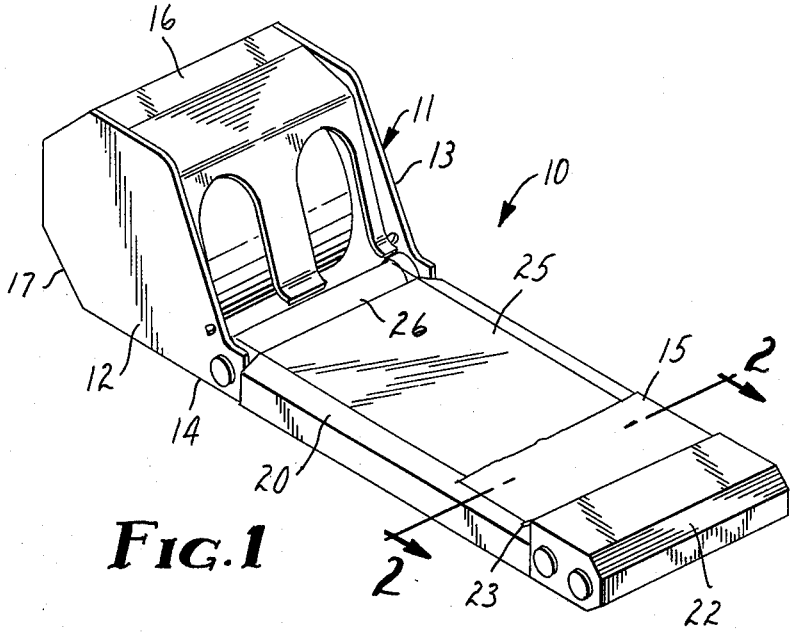
FIG. 1 is a perspective view of the notepaper dispenser of the present invention.
Figure 2:
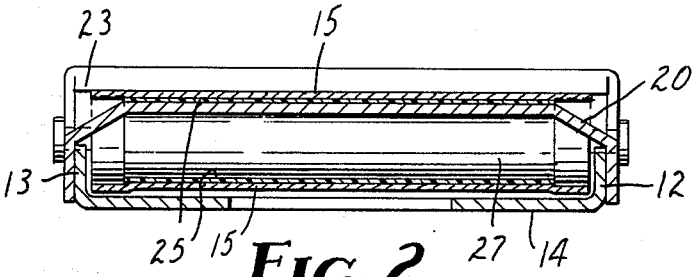
FIG. 2 is a cross-sectional view taken generally along the line 2—2 of FIG. 1.
Figure 3:
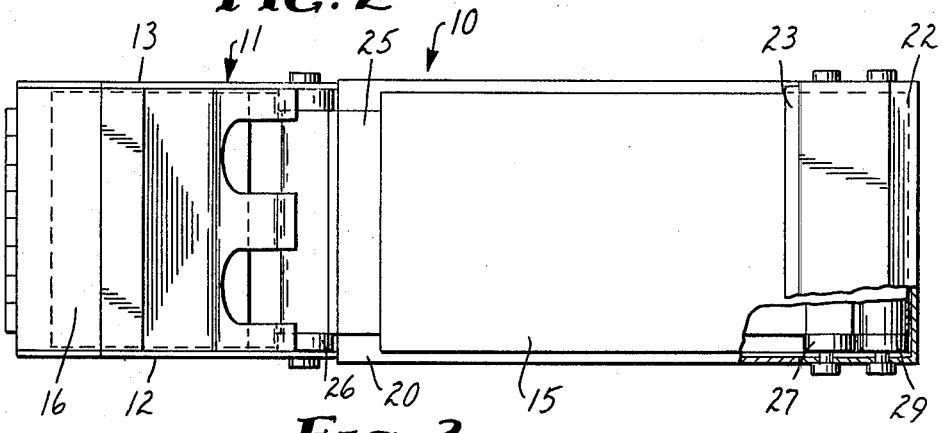
FIG. 3 is a top view of the notepaper dispenser.

The notepaper dispenser of the present invention is generally designated 10 and comprises a frame 11 formed of rolled or bent sheet metal having side members 12 and 13 which have an enlarged end portion and narrower longitudinally extending portions extending toward the front of the dispenser. The sidewalls 12 and 13 are joined by a bottom wall 14. The area between the enlarged end portions of the side members 12 and 13 defines a storage area for supporting a roll of notepaper 15 and a cover 16 is hinged to the backwall 17 of the bottom wall 14 to enclose the roll of notepaper.

A platform formed of sheet metal joins the upper portions of the longitudinally extending areas of the side members 12 and 13. The platform 20 forms an anvil surface for supporting the notepaper for inscription thereon by a writing instrument. A forward end cap 22 completes the frame and encloses the forward end of the dispenser and is spaced slightly above the forward end of the platform 20 and has an inclined lip 23 which is directed toward the platform to direct the notepaper toward the platform.

An endless belt 25 encloses the platform 20 and is guided about the platform to carry the notepaper from the supply roll toward the forward end of the dispenser and back onto the upper surface of the platform 20. The endless belt 25 is trained around two smooth spaced parallel arcuate surfaces. As illustrated these surfaces are formed by a first cylindrical roller 26 extending transversely between the side walls 12 and 13 and a second cylindrical roller 27 disposed at the opposite end of the platform 20 and parallel to the roller 26. The belt 25 is preferably a transparent belt of polymeric material which is thermally stable, e.g. polyester and provides a low adhesion surface for the notepaper 15.

To direct the paper from the lower stretch of the belt between the rollers 26 and 27 around to the upper stretch of the belt is a guide roller 29 which is positioned parallel to the roller 27 and spaced slightly therefrom toward the forward end of the dispenser and beneath the forward cover 22.

Without the use of the guide roller 29, the notepaper gathered and wrinkled as it passed with the belt around the roller 27. The notepaper binding on the belt was due to the difference in circumference of the surface traced by the belt about the roller 27 and the circumference of the surface traced by the notepaper. The difference is about 3 mm in that one-half a revolution. Since the paper would not stretch, due to the adhesive, the belt gathered and wrinkled causing wrinkles in the notepaper. The guide roller 29 removes the wrinkling of the belt and that of the notepaper. As the belt makes a turn about the roller 27 the stiffer notepaper as illustrated separates from the belt and is directed to the guide roller 29 and is carried about the guide roller 29 and directed back onto the belt beneath the depending flange 23 of the cover 22 to re-engage the belt and place the adhesive coated surface in engagement with the belt 25.

The notepaper 15 is preferably a suitable paper stock coated on one surface with a stripe or area of a microstructure adhesive 30 which is a pressure sensitive adhesive having a low tack permitting it to be applied and removed easily from a receptor surface. The preferred adhesive 30 is an acrylate copolymer which is described and claimed in U.S. Pat. No. 3,691,140, issued Sept. 12, 1972 to S. F. Silver, and assigned to the assignee of this application, and incorporated herein by reference. The adhesive is described as having infusible solvent-dispersible, solvent-insoluble, inherently tacky, elastomeric copolymer microspheres consisting essentially of about 90 percent to about 99.5 percent by weight of at least one alkyl acrylate ester and about 10 to about 0.5 percent by weight of at least one monomer selected from the group consisting of substantially oil-insoluble, water-insoluble, ionic monomers and maleic anhydride. The microspheres are prepared by aqueous suspension polymerization utilizing emulsifier in an amount greater than the critical micelle concentration in the absence of externally added protective colloids or the like.

Figure 4:
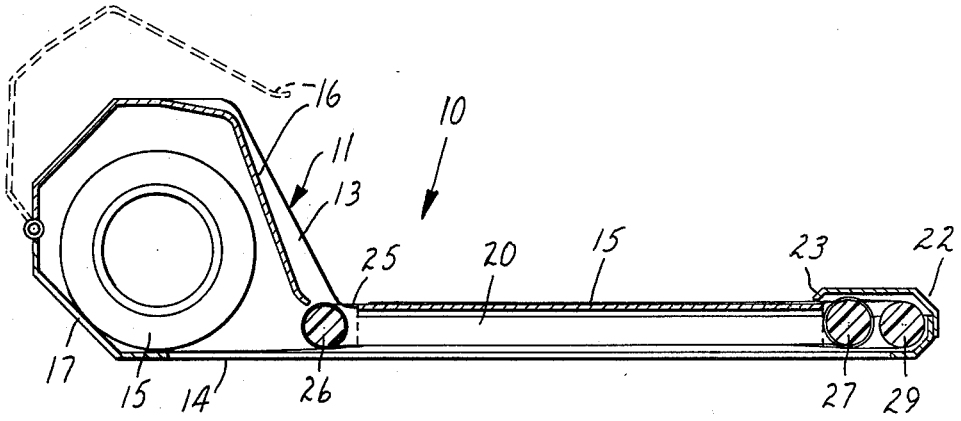
FIG. 4 is a vertical sectional view of the notepaper dispenser.
Figure 5:
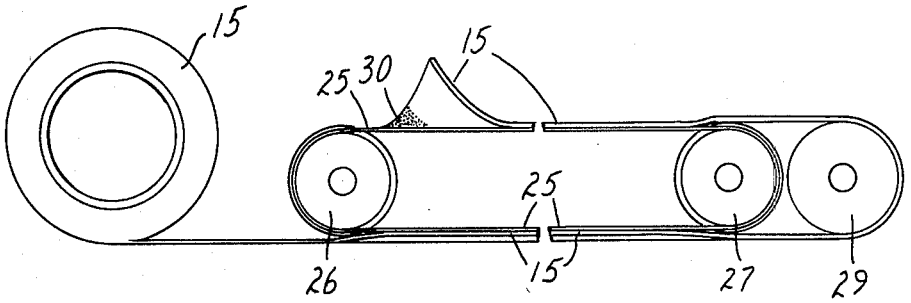
FIG. 5 is a schematic view of the notepaper, the dispensing belt and the guide roller taken in side elevation.

The dispenser of the present invention permits the notepaper 15 to be advanced by the operator engaging the belt 25 with his thumb or forefinger and causing the belt to rotate about the rollers 25 and 27 in a counterclockwise direction as viewed in FIGS. 4 and 5. As the belt 25 is rotated the notepaper is advanced from the roll toward the forward portion of the dispenser, where it is guided around the roller 29 and back onto the belt 25 to be disposed on the upper surface of the belt above the platform 20. Notes may be inscribed on the notepaper and then the notepaper is peeled from the belt as illustrated in FIG. 5 and torn across its width by lifting the paper against the flange 23 of the front cover 22. The note may then be applied to another sheet of paper, a bulletin board or other receptor surface for the note.

Having described the present invention with respect to the preferred embodiment it is to be understood that further changes may be made in the construction of the present invention without departing from the spirit or scope of the present invention as described in the appended claims.

I claim:

1. A notepaper dispenser for use in dispensing variable length sheets of notepaper with messages which notepaper has a pressure sensitive adhesive coated on a surface of the paper opposite the writing surface, said dispenser comprising a frame having a pair of side walls, means defining therebetween a support for a roll of notepaper, and a platform extending between said sidewalls, a pair of spaced arcuate surfaces extending transversely between said side walls and positioned one at each end of said platform, an endless belt positioned about said pair of arcuate surfaces to enclose said platform, and a guide roller placed parallel to and spaced from the arcuate surface farthest from said support for a roll of notepaper to carry said notepaper from one surface of the belt around said guide roller and back onto the belt above said platform.

2. A dispenser as claimed in claim 1 wherein said belt is a transparent polymeric belt.

3. A dispenser as claimed in claim 1 or claim 2 wherein said pair of arcuate surfaces are defined by a pair of spaced cylindrical rollers.

4. A notepaper dispenser comprising a roll of notepaper having a coating of a pressure sensitive adhesive on a surface of the paper opposite the writing surface, a frame having a pair of side walls, means defining a support for said roll of notepaper, a platform extending between said sidewalls, and a cover spaced from said support and including a flange spaced above one end of said platform, a pair of rotatable cylindrical rollers extending transversely between said side walls and positioned one at each end of said platform, an endless belt positioned about said pair of rollers and positioned above and below said platform to enclose said platform, and a guide roller placed parallel to and spaced from the roller farthest from said support for said roll of notepaper to carry said notepaper from one surface of the belt around said guide roller and back onto the belt above said platform and below said flange.

* * * * *